US009995304B2

(12) United States Patent
Lin

(10) Patent No.: US 9,995,304 B2
(45) Date of Patent: Jun. 12, 2018

(54) CENTRIFUGAL FAN AND IMPELLER THEREOF

(71) Applicant: DELTA ELECTRONICS, INC., Taoyuan Hsien (TW)

(72) Inventor: Hsin-Chen Lin, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 872 days.

(21) Appl. No.: 13/912,922

(22) Filed: Jun. 7, 2013

(65) Prior Publication Data

US 2014/0308118 A1 Oct. 16, 2014

(30) Foreign Application Priority Data

Apr. 10, 2013 (TW) ..... 102112620 A

(51) Int. Cl.

| | |
|---|---|
| ***F04D 17/16*** | (2006.01) |
| ***F04D 25/06*** | (2006.01) |
| ***F04D 29/28*** | (2006.01) |
| ***F04D 29/30*** | (2006.01) |
| ***F04D 29/66*** | (2006.01) |

(52) U.S. Cl.

CPC ..... *F04D 17/16* (2013.01); *F04D 25/0613* (2013.01); *F04D 29/281* (2013.01); *F04D 29/30* (2013.01); *F04D 29/666* (2013.01)

(58) Field of Classification Search

CPC ..... F04D 17/16; F04D 29/281; F04D 29/30; F04D 29/326–29/329; F04D 29/663; F04D 29/666; F04D 25/0613; F04D 25/064; F04D 25/0646; H05K 7/20136; H05K 7/20172

See application file for complete search history.

(56) References Cited

U.S. PATENT DOCUMENTS

| | | | | |
|---|---|---|---|---|
| 4,253,800 | A * | 3/1981 | Segawa | F01D 5/10 415/119 |
| 8,113,782 | B2 * | 2/2012 | Horng | F04D 29/023 416/178 |
| 9,777,743 | B2 * | 10/2017 | Yang | F04D 17/162 |
| 2002/0146318 | A1 * | 10/2002 | Horng | F04D 25/0613 415/204 |
| 2010/0232948 | A1 * | 9/2010 | Horng | F04D 17/16 415/182.1 |
| 2011/0052385 | A1 * | 3/2011 | Duke | F04D 29/281 415/203 |

FOREIGN PATENT DOCUMENTS

| | | |
|---|---|---|
| TW | M255650 | 1/2005 |
| TW | M300427 | 11/2006 |

* cited by examiner

*Primary Examiner* — Igor Kershteyn
*Assistant Examiner* — Brian P Wolcott
(74) *Attorney, Agent, or Firm* — Hauptman Ham, LLP

(57) ABSTRACT

A centrifugal fan includes an impeller. The impeller includes a hub, a plurality of connecting structures, an annular structure and a plurality of blades. The hub includes a circumferential surface. The connecting structures are disposed on the circumferential surface of the hub at intervals. Any adjacent two of the connecting structures define a first minimum distance on the circumferential surface. At least two first minimum distances are not equal. The annular structure is connected to the connecting structures. The blades are disposed on the annular structure at intervals.

18 Claims, 12 Drawing Sheets

CENTRIFUGAL FAN AND IMPELLER THEREOF

RELATED APPLICATIONS

This application claims priority to Taiwan Application Serial Number 102112620, filed Apr. 10, 2013, which is herein incorporated by reference.

BACKGROUND

Technical Field

The present invention is related to a fan. More particularly, the present invention is related to a centrifugal fan and the impeller thereof.

Description of Related Art

With the advent of the electronic devices toward higher efficiency and smaller size, the temperature of the electronic device in operation gets higher, which influences the reliability of the electronic devices. Therefore, a fan is usually installed in the electronic device for dissipating heat.

The centrifugal fan is one of the popular heat dissipation devices. This fan utilizes inlets on the upper surface and the lower surface to inhale the air, and utilizes an outlet on the lateral surface to discharge the air, so as to dissipate the heat.

When the centrifugal fan is working, the blades or the ribs in the fan passing through a particular location causes a periodical variation in air pressure. The frequency of the air pressure variation relates to the amount of the blades, the amount of the ribs in the fan, and the rotation speed of the fan. The sound volume of the centrifugal fan at this frequency is particularly high, which is uncomfortable for the user of the electronic device and thus is regarded as noises.

SUMMARY

A centrifugal fan with low noise is provided.

In accordance with one embodiment of the present invention, an impeller includes a hub, a plurality of connecting structures, an annular structure and a plurality of blades. The hub has a circumferential surface. The connecting structures are disposed at intervals and on the circumferential surface of the hub. Any adjacent two of the connecting structures define a first minimum distance on the circumferential surface. At least two of the first minimum distances are not equal. The annular structure is connected to the connecting structures. The blades are disposed at intervals and on the annular structure.

In accordance with another embodiment of the present invention, an impeller includes a hub, a plurality of connecting structures, an annular structure and a plurality of blades. The hub has a circumferential surface. The connecting structures are disposed at intervals and on the circumferential surface of the hub. Each of the connecting structures has two opposite end surfaces. The end surfaces of each connecting structure define a minimum distance on the circumferential surface. At least two of the minimum distances are not equal. The annular structure is connected to the connecting structures. The blades are disposed at intervals and on the annular structure.

In accordance with yet another embodiment of the present invention, a centrifugal fan includes a cover and an impeller. The cover has at least one inlet, an outlet and an accommodating space. The inlet, the accommodating space and the outlet are in spatial communication. The impeller is accommodated in the accommodating space of the cover. The impeller includes a hub, a plurality of connecting structures, an annular structure and a plurality of blades. The hub has a circumferential surface. The connecting structures are disposed at intervals and on the circumferential surface of the hub. Any adjacent two of the connecting structures define a first minimum distance on the circumferential surface. At least two of the first minimum distances are not equal. The annular structure is connected to the connecting structures. The blades are disposed at intervals and on the annular structure.

In accordance with yet another embodiment of the present invention, a centrifugal fan includes a cover and an impeller. The cover has at least one inlet, an outlet and an accommodating space. The inlet, the accommodating space and the outlet are in spatial communication. The impeller is accommodated in the accommodating space of the cover. The impeller includes a hub, a plurality of connecting structures, an annular structure and a plurality of blades. The hub has a circumferential surface. The connecting structures are disposed at intervals and on the circumferential surface of the hub. Each connecting structure has two opposite end surfaces. The end surfaces of each connecting structure define a minimum distance on the circumferential surface. At least two of the minimum distances are not equal. The annular structure is connected to the connecting structures. The blades are disposed at intervals and on the annular structure.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
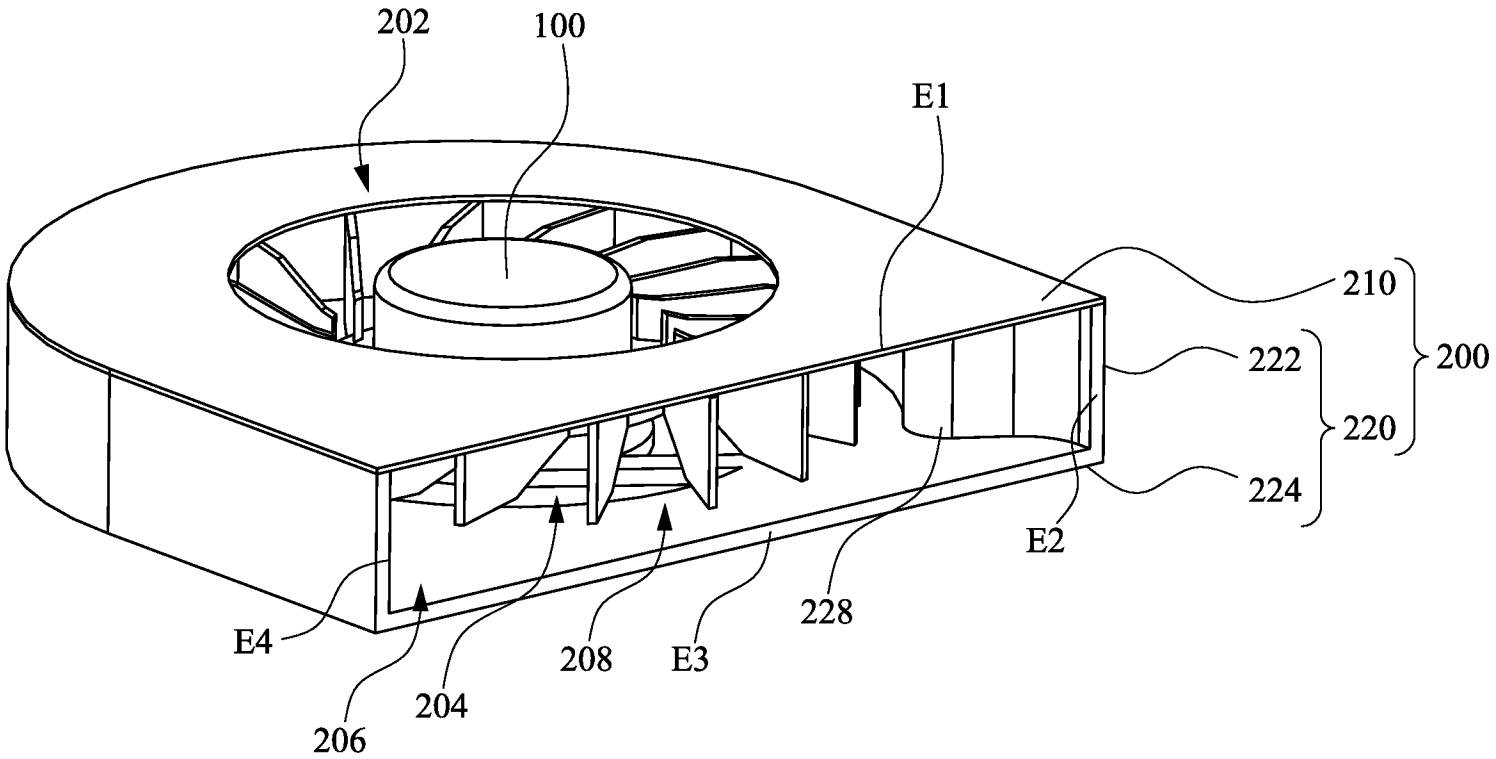
FIG. 1 is a perspective view of the centrifugal fan in accordance with the first embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
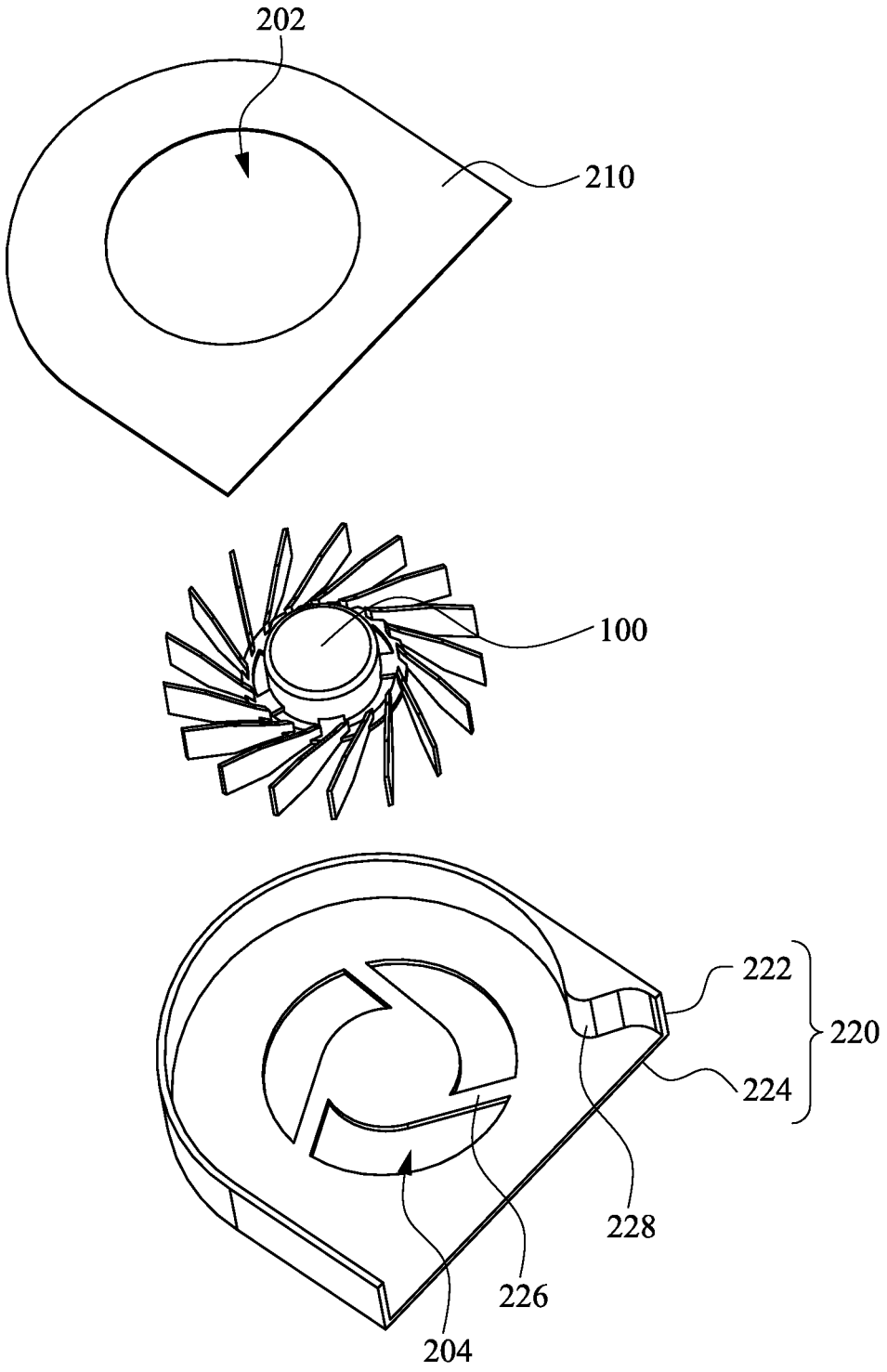
FIG. 2 is an explosive perspective view of the centrifugal fan shown in FIG. 1.

FIG. 1 is a perspective view of the centrifugal fan in accordance with the first embodiment of the present invention. FIG. 2 is an explosive perspective view of the centrifugal fan shown in FIG. 1. As shown in FIGS. 1 and 2, the centrifugal fan includes an impeller 100 and a cover 200. The cover 200 includes an upper cover body 210 and a lower cover body 220. The upper cover body 210 can be assembled on the lower cover body 220. The lower cover body 220 includes a flow channel wall 222 and a bottom plate 224. The flow channel wall 222 stands on the bottom plate 224. When the upper cover body 210 is assembled on the lower cover body 220, the flow channel wall 222 supports the upper cover body 210 such that the bottom plate 224 can be spaced apart from the upper cover body 210. The upper cover body 210, the flow channel wall 222 and the bottom plate 224 define an accommodating space 208. The impeller 100 can be accommodated in the accommodating space 208. The cover 208 has an inlet 202, a plurality of inlets 204 and an outlet 206. The inlet 202 is disposed on the upper cover body 210. The inlets 204 are disposed on the bottom plate 224. The upper cover body 210 has an edge E1. The bottom plate 224 has an edge E3 substantially parallel to the edge E1. The flow channel wall 222 has edges E2 and E4 substantially parallel to each other. The edges E1, E2, E3 and E4 are connected with each other and thereby define the outlet 206. The inlet 202, the inlets 204, the accommodating space 208 and the outlet 206 are in spatial communication. Therefore, when the centrifugal fan is working, the impeller 100 can rotate to inhale the air above the upper cover body 210 and the air under the bottom plate 224 into the accommodating space 208 by the inlet 202 and the inlets 204. Meanwhile, the impeller 100 can discharge the air in the accommodating space 208 through the outlet 206 so as to dissipate heat.

As shown in FIGS. 1 and 2, the lower cover body 220 can alternatively includes a throat 228. The throat 228 is protruded from the inner side of the flow channel wall 222 close to the outlet 206 so as to prevent the air discharging out of the outlet 206 from flowing back to the accommodating space 208, thereby promoting the heat dissipation ability.

As shown in FIG. 2, the bottom plate includes a plurality of ribs 226. The inlets 204 on the bottom plate 224 are separated by the ribs 226. The projection position that the impeller 100 projects to the bottom plate 224 overlaps with the ribs 226. When the impeller 100 rotates, if the blades or other structures (such as the connecting structure connected to the hub) pass through the ribs 226 at the same time interval, the air pressure varies periodically such that the sound volume of the centrifugal fan at a particular frequency will be noticeably higher than the sound volume at other frequencies. This particular frequency is referred as "structure pass frequency" hereinafter, and the value thereof is the multiple of the amount of the ribs or the amount of the blades.

Figure 3:
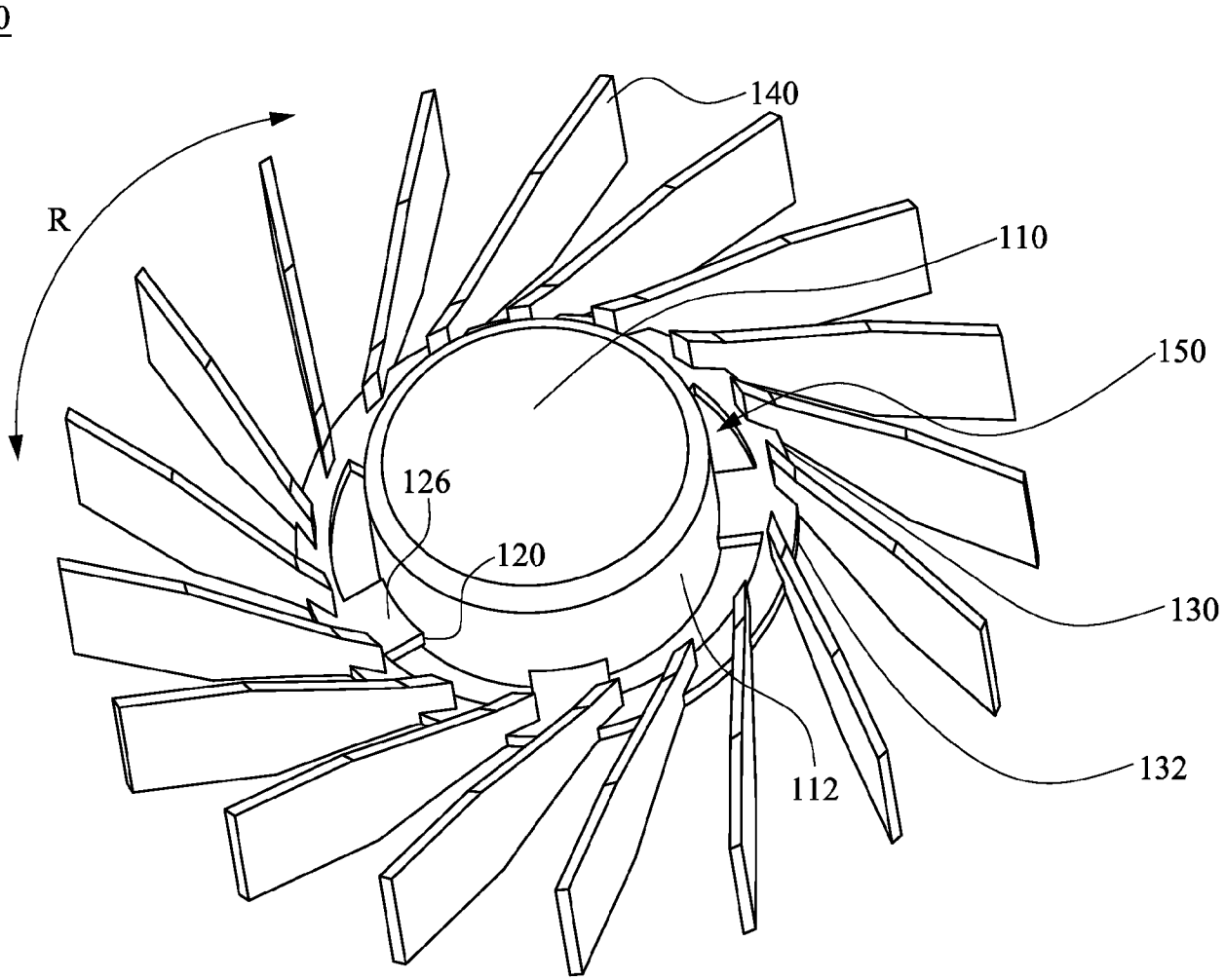
FIG. 3 is a perspective view of the impeller shown in FIG. 2.
Figure 4:
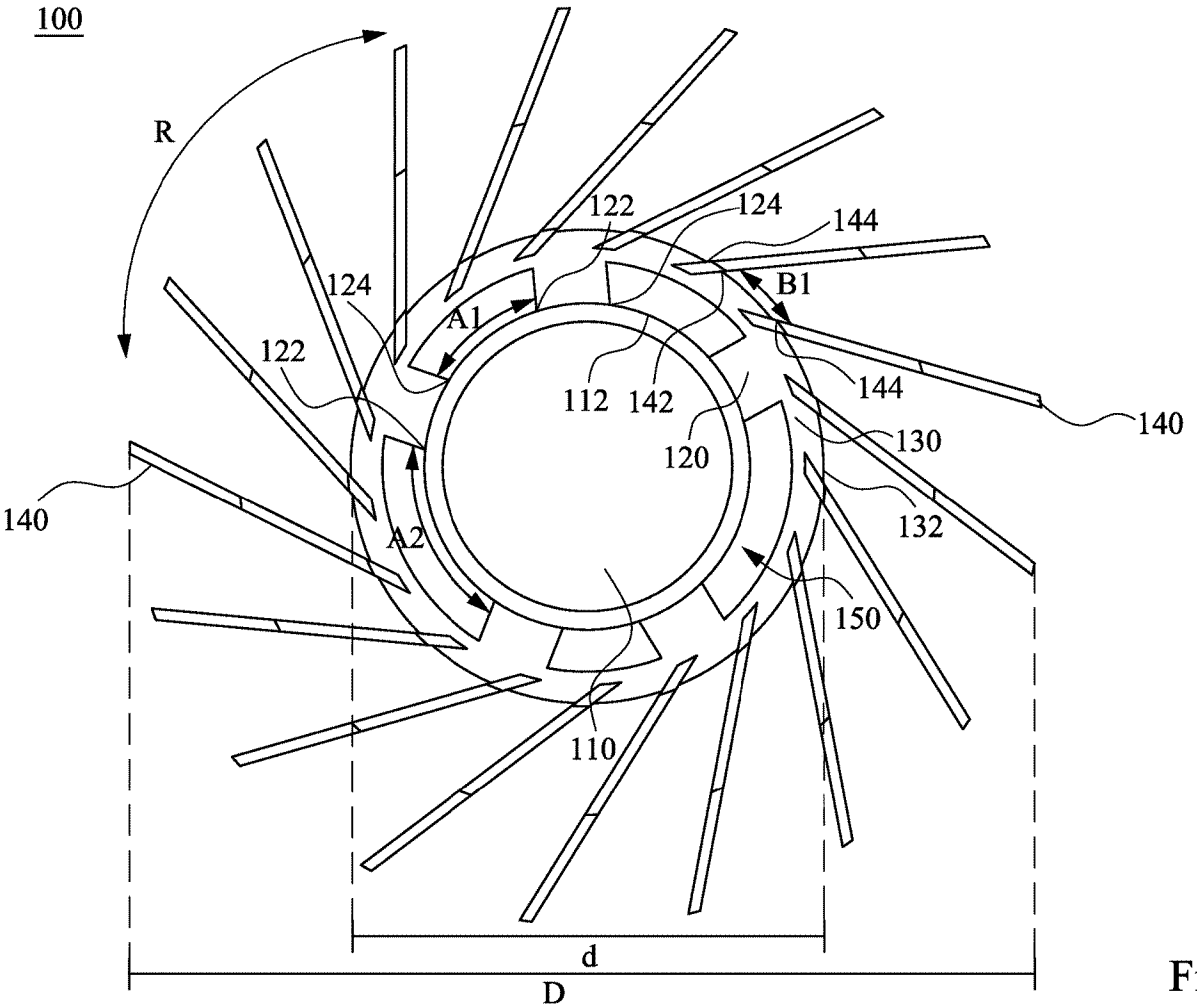
FIG. 4 is a top view of the impeller shown in FIG. 2.

The present invention provides an impeller 100 that disables the air pressure varying periodically so that the sound volume of the centrifugal fan at the structure pass frequency can be lowered. FIG. 3 is a perspective view of the impeller 100 shown in FIG. 2, and FIG. 4 is a top view of the impeller 100 shown in FIG. 2. The impeller 100 includes a hub 110, a plurality of connecting structures 120, an annular structure 130 and a plurality of blades 140. The hub 110 has a circumferential surface 112. The connecting structures 120 are disposed at intervals and on the circumferential surface 112 of the hub 110. The connecting structures 120 extend outwardly along the normal line of the circumferential surface 112. The annular structure 130 is connected to the connecting structures 120 opposite to the hub 110, and surrounds the connecting structures 120 and the hub 110. The blades 140 are disposed at intervals and on the annular structure 130 opposite to the connecting structures 120.

As shown in FIG. 4, adjacent two of the connecting structures 120 define a first minimum distance A1 on the circumferential surface 112. Another adjacent two of the connecting structures 120 define a first minimum distance A2 on the circumferential surface 112. The first minimum distance A1 and the first minimum distance A2 are not equal. Therefore, the connecting structures 120 arrive at the rib 226 (See FIG. 2) at different time intervals so that the air pressure will not vary periodically, thereby lowering the noise.

Preferably, all of the first minimum distances between the connecting structures 120 are not equal so that the connecting structures 120 can be arranged on the hub 110 non-equidistantly, thereby promoting the noise reduction ability.

As shown in FIG. 4, each connecting structure 120 includes a first boundary 122 and a second boundary 124. The first boundary 122 and the second boundary 124 are both joined to the circumferential surface 112. The circumferential surface 112 has a circumferential direction R. The circumferential direction R refers to the path that an object goes along when it revolves around the circumferential surface 112 on the same level height. It is understood that the first minimum distance in this context refers to the distance measured between the first boundary 122 of the connecting structure 120 and the second boundary 124 of the adjacent connecting structure 120 along the circumferential direction R on the circumferential surface 112.

As shown in FIGS. 3 and 4, the amount of the blades 140 is greater than the amount of the connecting structures 120. Therefore, the distance between the connecting structures 120 can be greater so as to increase the size of the hole 150 defined between adjacent two of the connecting structures 120, thereby allowing more air to flow therethrough.

In some situations, the projection positions of the connecting structures 120 and the projection positions of the blades 140 on the bottom plate 224 partially overlap with the ribs 226 (See FIG. 2), and the connecting structures 120 and the blades 140 both pass by the top of the ribs 226, so the value of the structure pass tone may be the common multiple of the amount of the connecting structures 120 and the amount of the blades 140. However, when the frequency of the sound is higher, the energy decays greater, and the sound volume is lower. Therefore, if the structure pass frequency can be higher, the sound volume of the centrifugal fan at the structure pass frequency can be lowered. Therefore, in some embodiments, the amount of the blades 140 and the amount of the connecting structures 120 are prime numbers mutually. In other words, the greatest common divisor of the amount of the blades 140 and the amount of the connecting structures 120 is 1. Therefore, the least common multiple can be the product of the amount of the blades 140 and the amount of the connecting structures 120 so as to increase the value of the structure pass frequency, thereby reducing the noise. Preferably, the amount of the connecting structures 120 is less than or equal to 13, and the amount of the blades 140 is greater than 13.

As shown in FIG. 4, in this embodiment, the annular structure 130 has an outer annular surface 130. Any adjacent two of the blades 140 define a second minimum distance B1 on the outer annular surface 132. All of the second minimum distances B1 between the blades 140 are equal. As shown in FIG. 4, each blade 140 includes a first joint part 142 and a second joint part 144. The first joint part 142 and the second joint part 144 are both joined to the outer annular surface 132. It is understood that the second minimum distance in this context refers to the distance measured between the first joint part 142 of one blade 140 and the second joint part 144 of the adjacent blade 140 along the circumferential direction R on the outer annular surface 132.

As shown in FIG. 4, in this embodiment, two of the blades 140 farthest to each other define an outer diameter D, and the annular structure 130 has an outer diameter d. The outer diameter d and the outer diameter D substantially satisfy the relation of $40\% \times D < d < 85\% \times D$. Such a relation can promote the air discharging ability of the centrifugal fan.

As shown in FIG. 3, each of the connecting structures 120 has at least one largest surface 126 with maximal area. The circumferential direction R is substantially parallel to the largest surface 126 of each connecting structure 120. Therefore, the connecting structures 120 can be flat, blade-shaped or rib-shaped.

Figure 5:
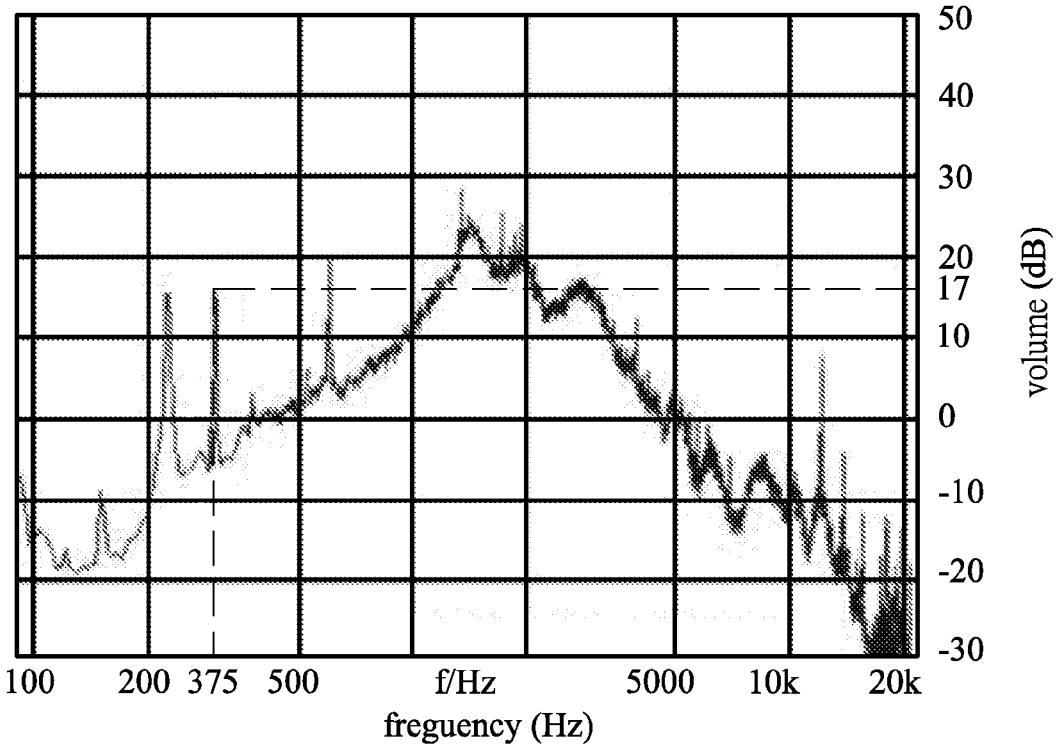
FIG. 5 is a chart showing the volume versus the frequency of the centrifugal fan in accordance with the first embodiment.
Figure 6:
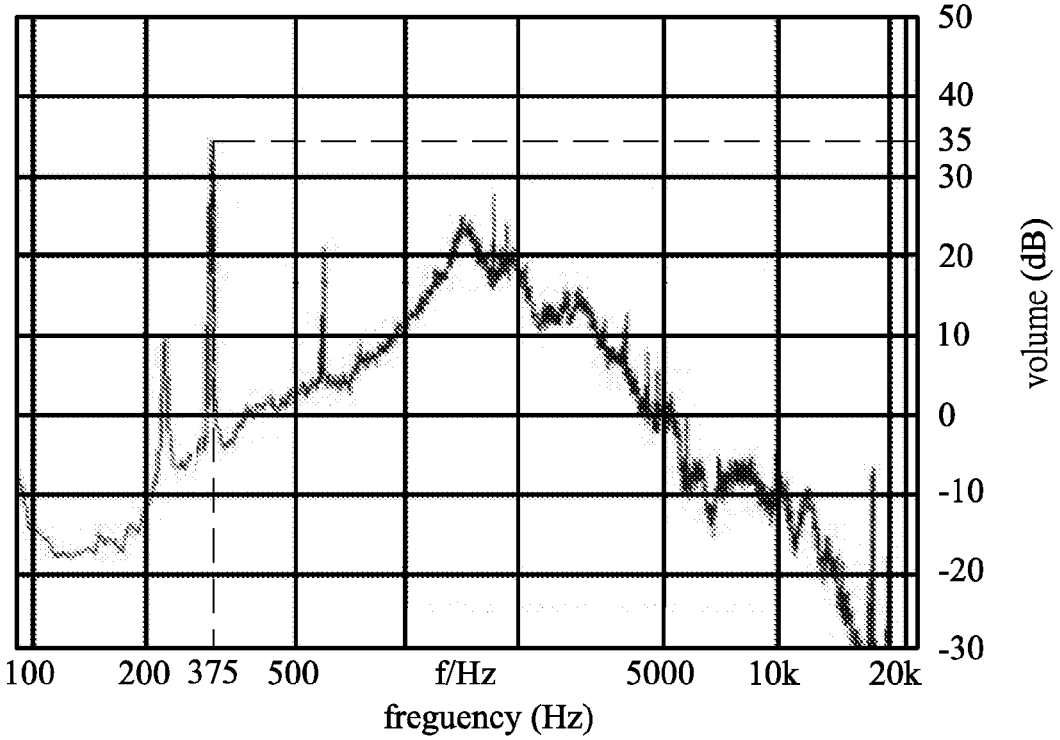
FIG. 6 is a chart showing the volume versus the frequency of the centrifugal fan when the connecting structures are equidistantly arranged.

FIG. 5 is a chart showing the volume versus the frequency of the centrifugal fan in accordance with the first embodiment of the present invention, in which the impeller 100 includes non-equidistantly arranged connecting structures 120. As shown FIG. 5, the structure pass frequency is about 375 Hz, and the sound volume measured at this frequency is about 17 dB. FIG. 6 is a chart showing the volume versus the frequency of the centrifugal fan when the connecting structures 120 are equidistantly arranged. As shown in FIG. 6, the structure pass frequency is about 375 Hz, and the sound volume measured at this frequency is about 35 dB. According to FIGS. 5 and 6, when two centrifugal fans have the same size and rotate at the same speed, 4500 rpm, the one that includes non-equidistantly arranged connecting structures 120 has lower sound volume at the structure pass frequency. For example, the sound volume at 375 Hz in FIG. 5 is almost half of the sound volume at 375 Hz in FIG. 6.

Figure 7:
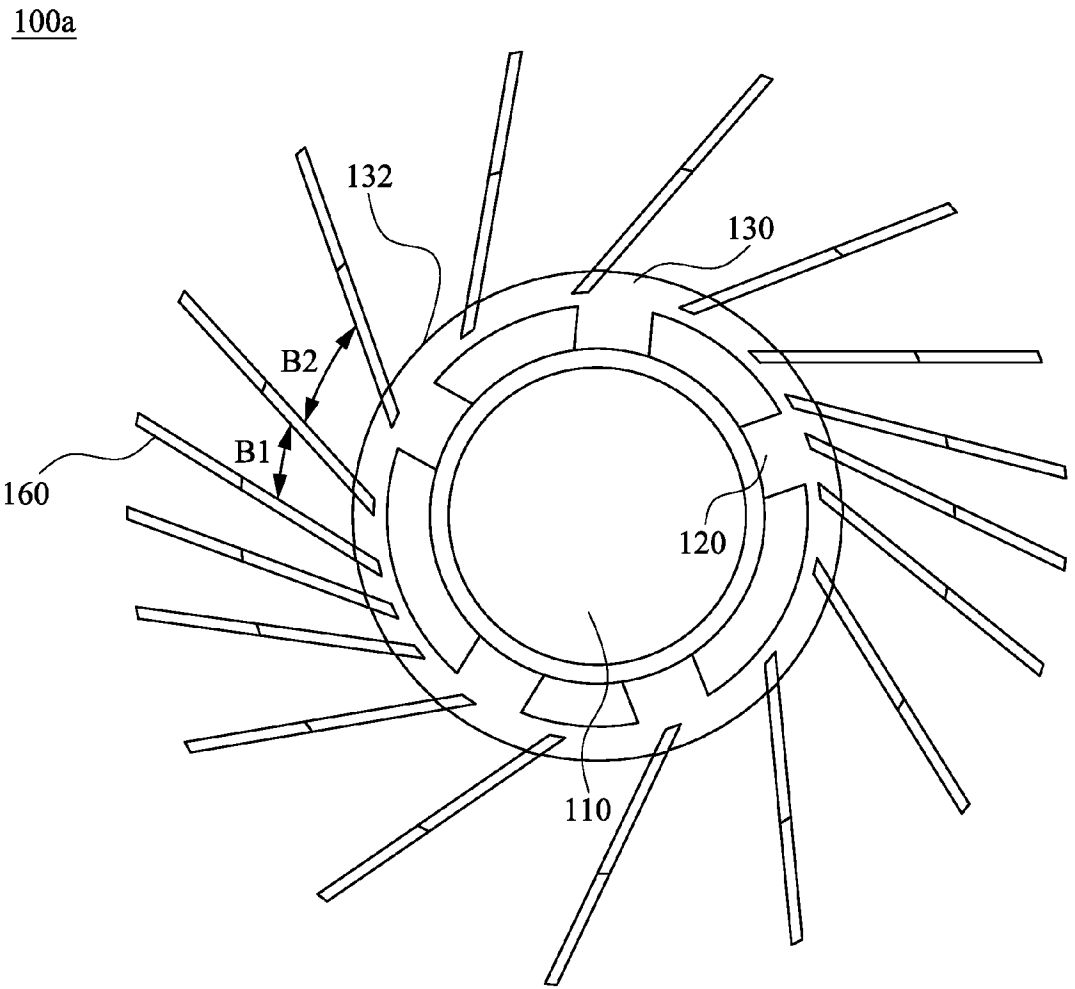
FIG. 7 is a top view of the impeller in accordance with the second embodiment of the present invention.

FIG. 7 is a top view of the impeller 100*a* in accordance with the second embodiment of the present invention. As shown in FIG. 7, the main difference between this embodiment and the first embodiment is that the impeller 100*a* includes a plurality of blades 160. Adjacent two of the blades 160 define a second minimum distance B1 on the outer annular surface 132, and another adjacent two of the blades 160 define a second minimum distance B2 on the outer annular surface 132. The second minimum distance B1 is not equal to the second minimum distance B2. Therefore, the volume at the structure pass frequency can be lowered by the unequal distances between the blades 160.

Preferably, all of the second minimum distances between the blades 160 are not equal so that the blades 160 can be arranged on the outer annular surface 132 non-equidistantly, thereby promoting the noise reduction ability.

The other features in this embodiment are the same as shown in the first embodiment, and the detail will not be described repeatedly.

Figure 8:
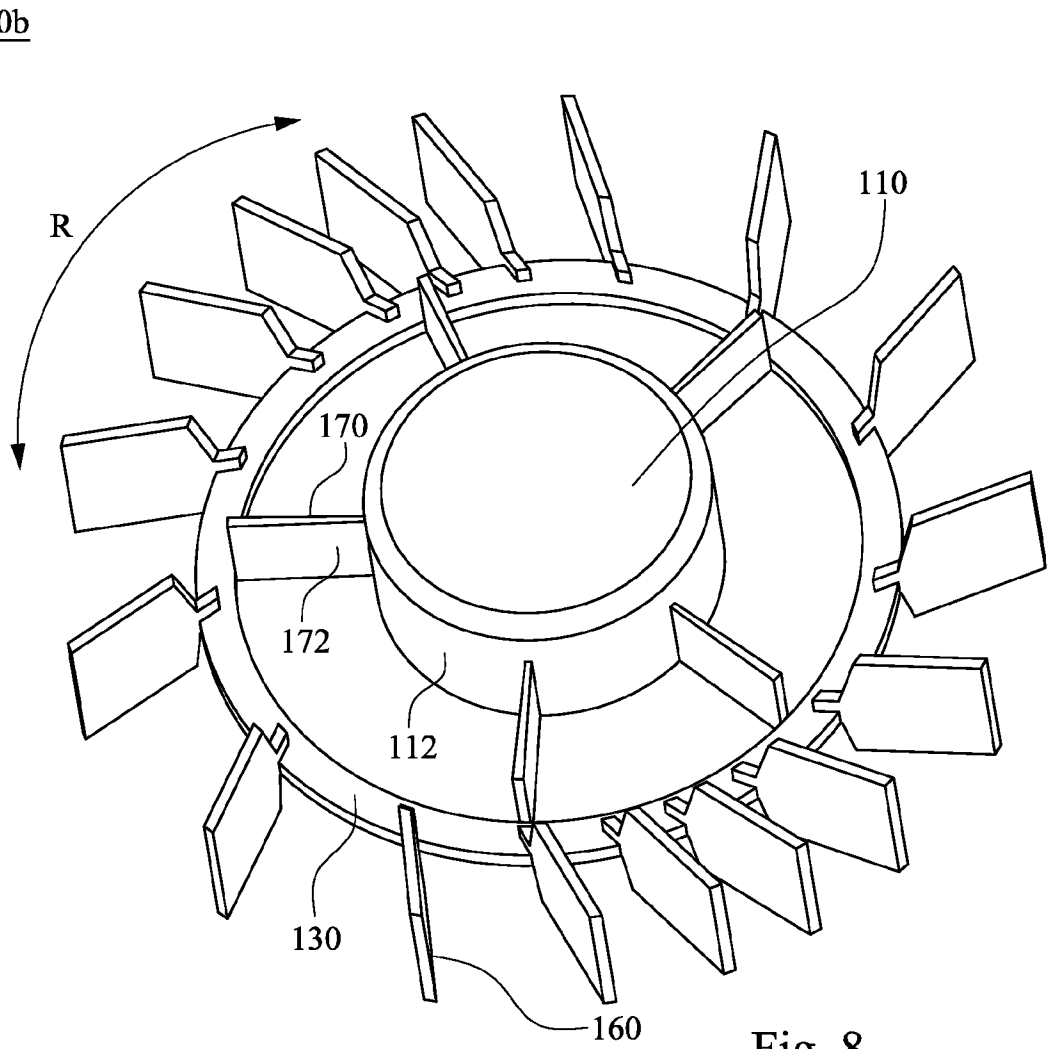
FIG. 8 is a perspective view of the impeller in accordance with the third embodiment of the present invention.

FIG. 8 is a perspective view of the impeller 100*b* in accordance with the third embodiment of the present invention. As shown in FIG. 8, the main difference between this embodiment and the first embodiment is that each of the connecting structures 170 of the impeller 100*b* includes the largest surface 172. The circumferential direction R of the circumferential surface 112 is substantially perpendicular to or sloped to the largest surface 172 of each connecting structure 170. In other words, the connecting structures 170 can be blade-shaped. Therefore, when the impeller 100*b* rotates along the circumferential direction R, the largest surfaces 172 of the connecting structures 170 can enforce the air to flow. In a preferred embodiment, the amount of the connecting structures can be less than 7, and the amount of the blades can be greater than 17.

Figure 9:
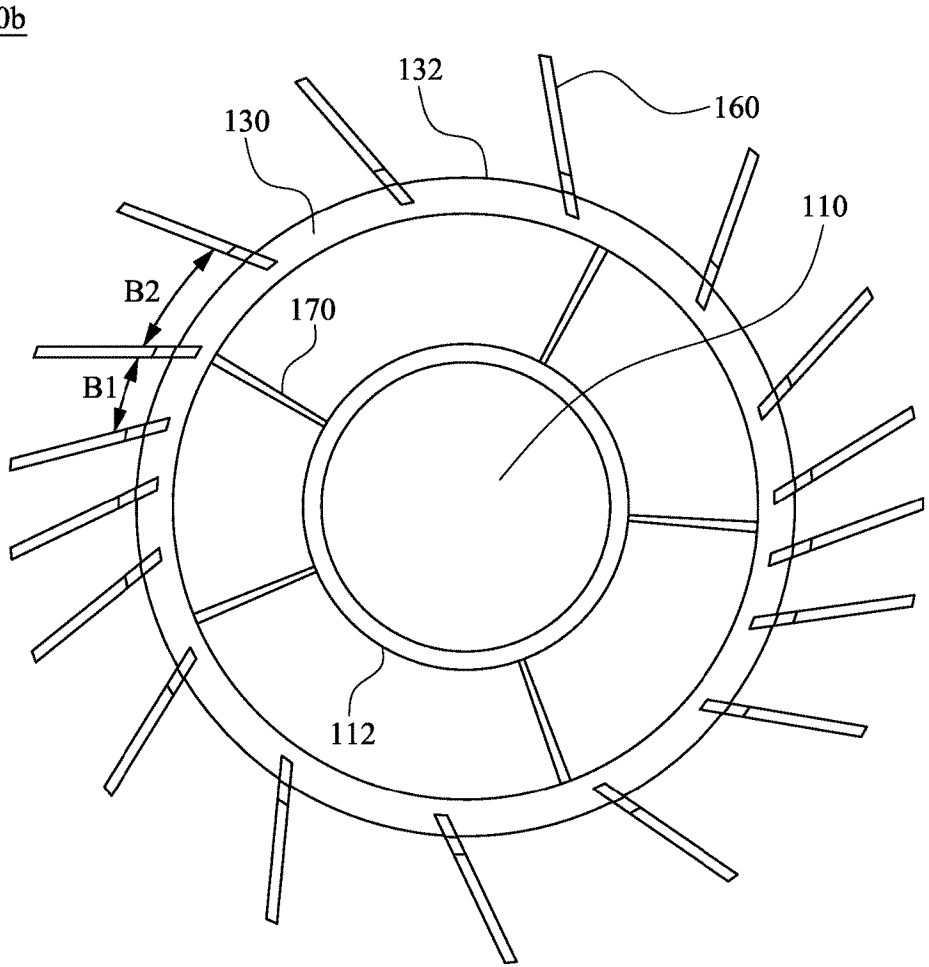
FIG. 9 is a top view of the impeller shown in FIG. 8.

FIG. 9 is a top view of the impeller 100*b* in FIG. 8. As shown in FIG. 9, the impeller 100*b* includes a plurality of blades 160. Adjacent two of the blades 160 define a second minimum distance B1 on the outer annular surface 132, and another adjacent two of the blades 160 define a second minimum distance B2 on the outer annular surface 132. The second minimum distance B1 is not equal to the second minimum distance B2. Therefore, the sound volume at the structure pass frequency can be lowered by the unequal distances between the blades 160.

Preferably, all of the second minimum distances between the blades 160 are not equal so that the blades 160 can be arranged on the outer annular surface 132 non-equidistantly, thereby promoting the noise reduction ability.

The other features in this embodiment are the same as shown in the first embodiment, so the detail will not be described repeatedly.

Figure 10:
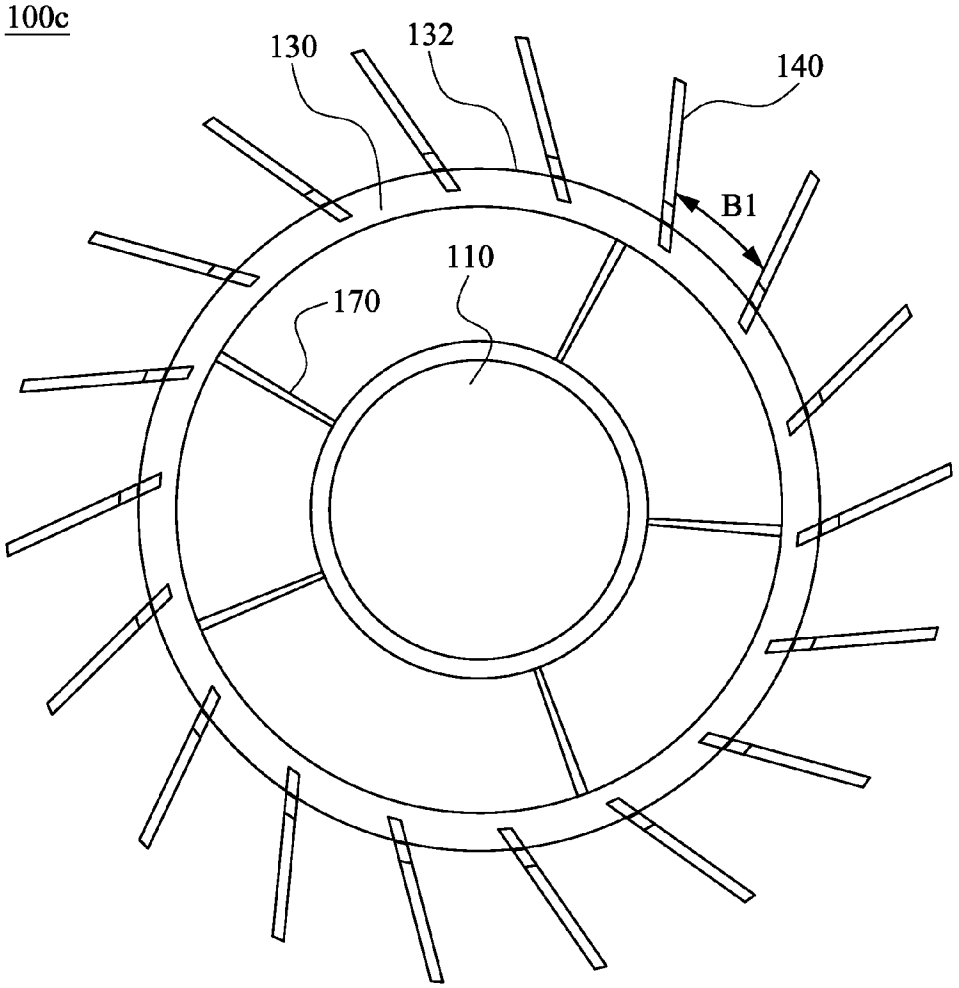
FIG. 10 is a top view of the impeller in accordance with the fourth embodiment of the present invention.

FIG. 10 is a top view of the impeller 100*c* in accordance with the fourth embodiment of the present invention. As shown in FIG. 10, the main difference between this embodiment and the third embodiment is that the impeller 100*c* includes a plurality of blades 140. Any adjacent two of the blades 140 define a second minimum distance B1 on the outer annular surface 132. All of the second minimum distances B1 between the blades 140 are equal.

The connecting structures 170 are the same as shown in the foregoing third embodiment, and other features in this embodiment are the same as shown in the first embodiment, and the detail will not be described repeatedly.

Figure 11:
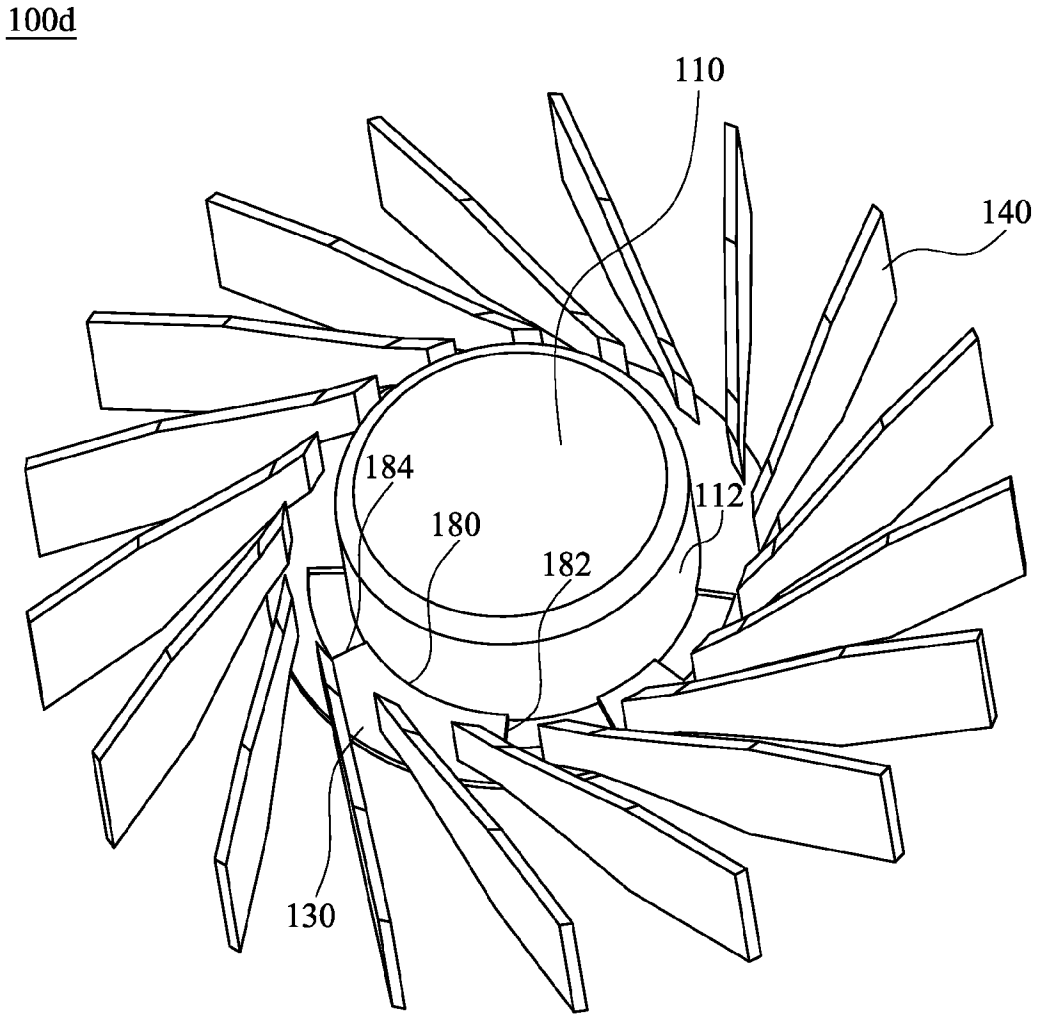
FIG. 11 is a perspective view of the impeller in accordance with the fifth embodiment of the present invention.
Figure 12:
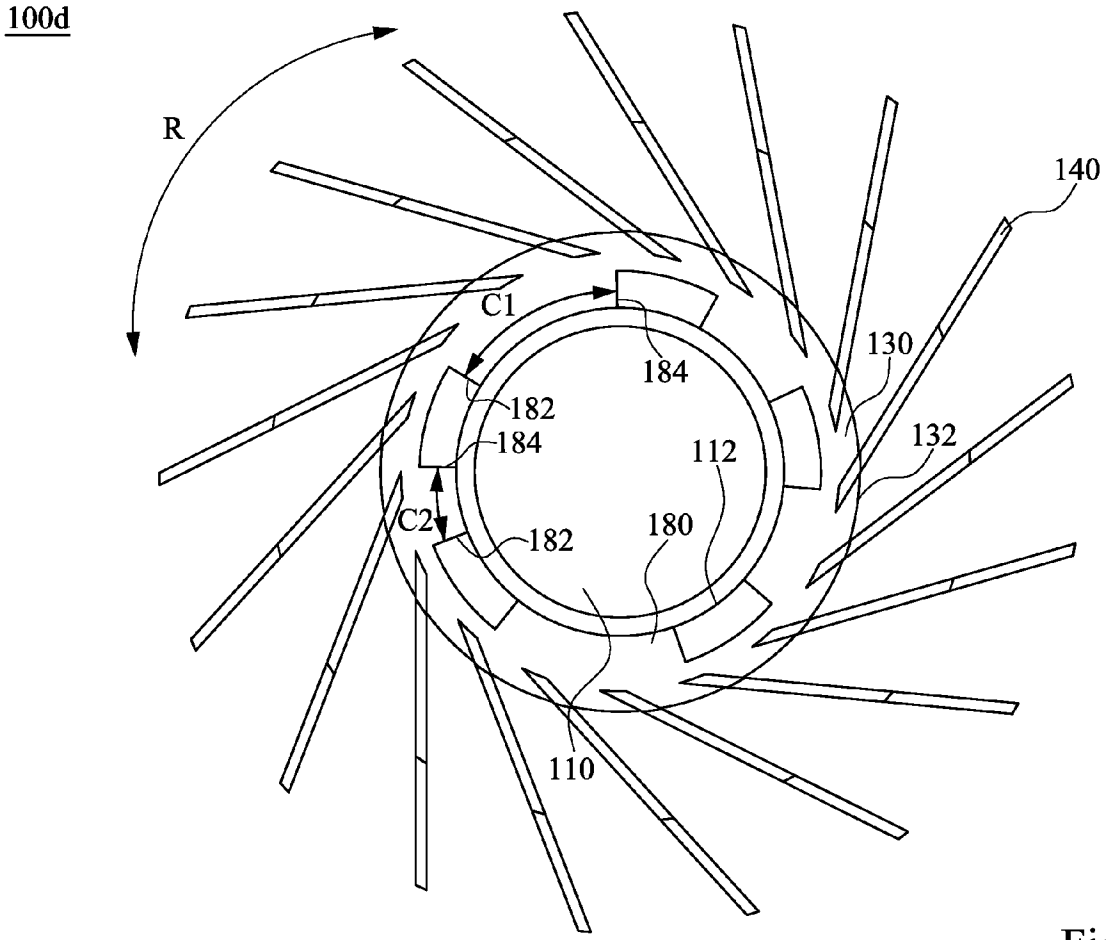
FIG. 12 is a top view of the impeller in FIG. 11.

FIG. 11 is a perspective view of the impeller 100*d* in accordance with the fifth embodiment of the present invention. FIG. 12 is a top view of the impeller 100*d* in FIG. 11. As shown in FIGS. 11 and 12, the main difference between this embodiment and the first embodiment is that the impeller 100*d* includes a plurality of connecting structures 180. The connecting structures 180 are disposed at intervals and on the circumferential surface 112 of the hub 110. The connecting structures 180 extend along the normal line of the circumferential surface 112. Each connecting structure 180 has two opposite end surfaces 182 and 184. The end surfaces 182 and 184 of one connecting structure 180 define a third minimum distance C1 on the circumferential surface 112, and the end surfaces 182 and 184 of another connecting structure 180 define a third minimum distance C2 on the circumferential surface 112. The third minimum distance C1 is not equal to the third minimum distance C2.

Therefore, the time that the connecting structures 180 pass by the top of the ribs (See FIG. 2) is unequal so that the air pressure will not vary periodically, thereby lowering the noise.

Preferably, all of the third minimum distances between the connecting structures 180 are not equal, thereby promoting the noise reduction ability.

It is understood that the third minimum distance in this context refers to the distance measured between the end surfaces 182 and 184 of one connecting structure 180 along the circumferential direction R on the circumferential surface 112.

The other features in this embodiment are the same as shown in the first embodiment, and the detail will not be described repeatedly.

Figure 13:
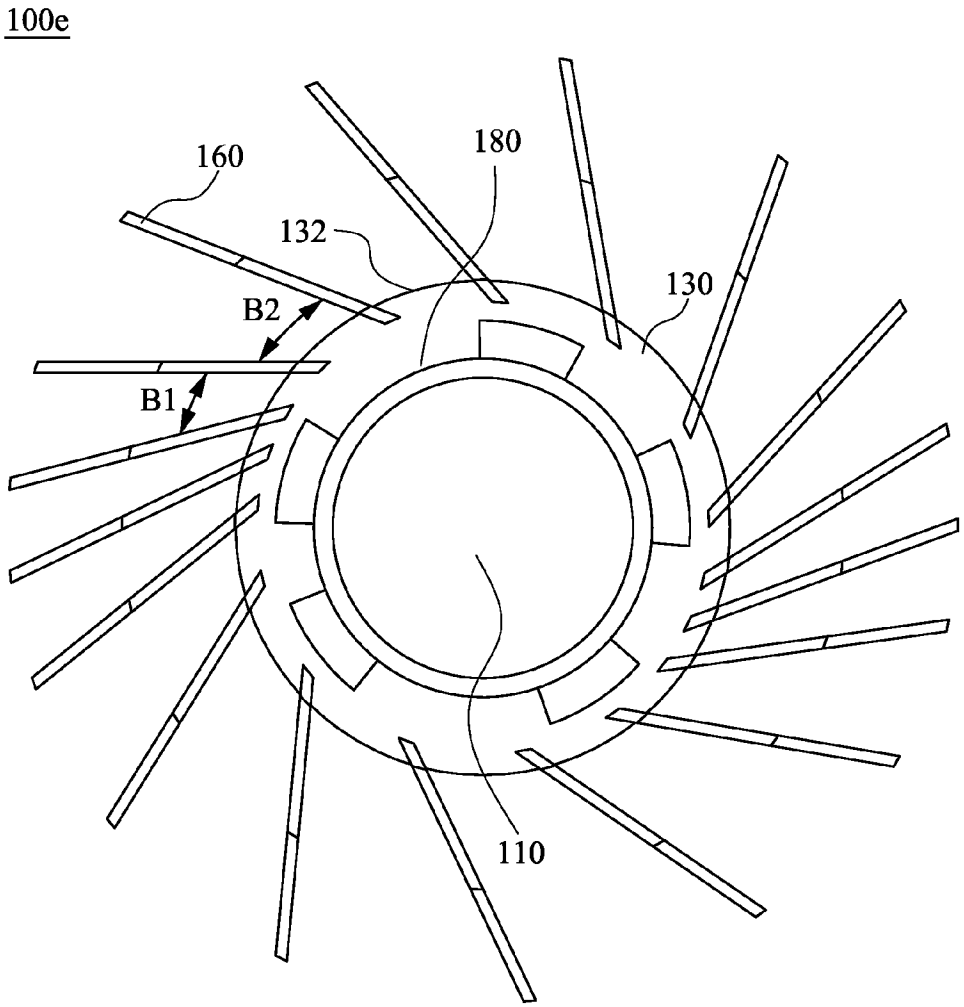
FIG. 13 is a top view of the impeller in accordance with the sixth embodiment of the present invention.

FIG. 13 is a top view of the impeller 100*e* in accordance with the sixth embodiment of the present invention. As shown in FIG. 13, the main difference between this embodiment and the fifth embodiment is that the impeller 100*e* includes a plurality of blades 160. Adjacent two of the blades 160 define a second minimum distance B1 on the outer annular surface 132, and another adjacent two of the blades 160 define a second minimum distance B2 on the outer annular surface 132. The second minimum distance B1 is not equal to the second minimum distance B2. Therefore, the sound volume at the structure pass frequency can be lowered by the unequal distances between the blades 160.

Preferably, all of the second minimum distances between the blades 160 are not equal, so that the blades 160 can be arranged on the outer annular surface 132 non-equidistantly, thereby promoting the noise reduction ability.

The connecting structures 180 are the same as shown in the fifth embodiment, and the other features in this embodiment are the same as shown in the first embodiment, and the detail will not be described repeatedly.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An impeller, comprising:

a hub having a circumferential surface;

a plurality of connecting structures disposed at intervals and on the circumferential surface of the hub, wherein any adjacent two of the plurality of connecting structures define a first minimum distance therebetween on the circumferential surface;

an annular structure connected to the plurality of connecting structures, wherein the annular structure comprises an outer annular surface; and a plurality of blades disposed at intervals and on the annular structure, wherein any adjacent two of the plurality of blades define a second minimum distance therebetween on the outer annular surface, adjacent two of the plurality of connecting structures defining the first minimum distance are located between the plurality of blades and the hub, a first difference between any two adjacent first minimum distances is different from a second difference between any two adjacent second minimum distances, and a least common multiple of a number of the plurality of blades and a number of the plurality of connecting structures is a product of the number of the plurality of blades and the number of the plurality of connecting structures.

2. The impeller of claim 1, wherein the number of the plurality of blades is greater than the number of the plurality of connecting structures.

3. The impeller of claim 1, wherein the number of the plurality of connecting structures is less than or equal to 13, and the number of the plurality of blades is greater than 13.

4. The impeller of claim 1, wherein two of the plurality of blades farthest from each other define an outer diameter D, and the annular structure has an annular structure outer diameter d, wherein the outer diameter d and the outer diameter D substantially satisfy a relation of $40\% \times D < d < 85\% \times D$.

5. The impeller of claim 1, wherein each of the plurality of connecting structures has at least one largest surface, and the circumferential surface has a circumferential direction, wherein the circumferential direction is substantially perpendicular to or sloped to the largest surface of each of the plurality of connecting structures.

6. The impeller of claim 1, wherein each of the plurality of connecting structures has at least one largest surface, and the circumferential surface has a circumferential direction, wherein the circumferential direction is substantially parallel to the largest surface of each of the plurality of connecting structures.

7. The impeller of claim 1, wherein each of the plurality of connecting structures is flat, blade-shaped or rib-shaped.

8. An impeller, comprising:

a hub having a circumferential surface;

a plurality of connecting structures disposed at intervals and on the circumferential surface of the hub, wherein each of the plurality of connecting structures has two opposite end surfaces, end surfaces of two adjacent connecting structures of the plurality of connecting structures define a first minimum distance on the circumferential surface, the two opposite end surfaces of each connecting structure on the circumferential surface is defined as a second minimum distance, and at least two of the second minimum distances are not equal to each other;

an annular structure connected to the plurality of connecting structures; and a plurality of blades disposed at intervals and on the annular structure.

9. The impeller of claim 8, wherein a least common multiple of a number of the plurality of blades and a number of the plurality of connecting structures is a product of the number of the plurality of blades and the number of the plurality of connecting structures.

10. The impeller of claim 8, wherein a number of the plurality of blades is greater than a number of the plurality of connecting structures.

11. The impeller of claim 8, wherein a number of the plurality of connecting structures is less than or equal to 13, and a number of the plurality of blades is greater than 13.

12. The impeller of claim 8, wherein the annular structure has an outer annular surface, wherein any adjacent two of the plurality of blades define a third minimum distance on the outer annular surface, wherein at least two of the third minimum distances are not equal.

13. The impeller of claim 8, wherein each of the plurality of connecting structures has at least one largest surface, and the circumferential surface has a circumferential direction, wherein the circumferential direction is substantially parallel to the largest surface of each of the plurality of connecting structures.

14. The impeller of claim 8, wherein each of the plurality of connecting structures is blade-shaped or flat rib-shaped.

15. A centrifugal fan, comprising:

a cover having at least one inlet, an outlet and an accommodating space, wherein the inlet, the accommodating space and the outlet are in spatial communication; and an impeller accommodated in the accommodating space of the cover, the impeller comprising:

a hub having a circumferential surface;

a plurality of connecting structures disposed at intervals and on the circumferential surface of the hub, wherein any adjacent two of the plurality of connecting structures define a first minimum distance therebetween on the circumferential surface;

an annular structure connected to the plurality of connecting structures, wherein the annular structure comprises an outer annular surface; and a plurality of blades disposed at intervals and on the annular structure, wherein any adjacent two of the plurality of blades define a second minimum distance therebetween on the outer annular surface, adjacent two of the plurality of connecting structures defining the first minimum distance are located between the plurality of blades and the hub, a first difference between any two adjacent first minimum distances is different from a second difference between any two adjacent second minimum distances, and a least common multiple of a number of the plurality of blades and a number of the plurality of connecting structures is a product of the number of the plurality of blades and the number of the plurality of connecting structures.

16. The centrifugal fan of claim 15, wherein a number of the at least one inlet is greater than one, and the cover comprises a bottom plate, wherein the bottom plate comprises a plurality of ribs, the at least one inlet is disposed on the bottom plate and are separated by the plurality of ribs, wherein the impeller overlaps with the ribs.

17. A centrifugal fan, comprising:

a cover having at least one inlet, an outlet and an accommodating space, wherein the inlet, the accommodating space and the outlet are in spatial communication; and an impeller accommodated in the accommodating space of the cover, the impeller comprising:

a hub having a circumferential surface;

a plurality of connecting structures disposed at intervals and on the circumferential surface of the hub, wherein each of the plurality of connecting structures has two opposite end surfaces, end surfaces of two adjacent connecting structures of the plurality of connecting structures define a first minimum distance on the circumferential surface, the two opposite end surfaces of connecting structure on the circumferential surface is defined as a second minimum distance, and at least two of the first minimum distances are not equal to each other, and at least two of the second minimum distances are not equal to each other;

an annular structure connected to the plurality of connecting structures; and a plurality of blades disposed at intervals and on the annular structure.

18. The centrifugal fan of claim 17, wherein a number of the at least one inlet is greater than one, and the cover comprises a bottom plate, wherein the bottom plate comprises a plurality of ribs, the at least one inlet is disposed on the bottom plate and are separated by the plurality of ribs, wherein the impeller overlaps with the plurality of ribs.

* * * * *